United States Patent [19]

Gustafsson

[11] Patent Number: 4,660,658

[45] Date of Patent: Apr. 28, 1987

[54] HYDRAULIC DOWN-THE-HOLE ROCK DRILL

[75] Inventor: Per S. G. Gustafsson, Lidingö, Sweden

[73] Assignee: Atlas Copco Aktiebolag, Nacka,

[21] Appl. No.: 746,244

[22] Filed: Jun. 18, 1985

[30] Foreign Application Priority Data

Jun. 25, 1984 [SE] Sweden ..... 8403370

[51] Int. Cl.[4] ..... E21B 4/14

[52] U.S. Cl. ..... 175/296; 173/80; 173/136; 91/224

[58] Field of Search ..... 175/293, 296, 297, 299; 173/78, 80, 135, 136; 91/394, 395, 400, 410, 415, 417, 222, 235, 229

[56] References Cited

U.S. PATENT DOCUMENTS

| | | | |
|---|---|---|---|
| 2,979,033 | 4/1961 | Bassinger | 91/235 X |
| 3,084,673 | 4/1963 | Sears | 173/78 X |
| 3,085,555 | 4/1963 | Morrison | 173/78 X |
| 3,431,984 | 3/1969 | Buehler et al. | 175/297 X |
| 3,616,868 | 11/1971 | Bassinger | 173/80 X |
| 4,450,920 | 5/1984 | Krasnoff et al. | 173/80 |

*Primary Examiner*—Stephen J. Novosad
*Assistant Examiner*—David J. Bagnell
*Attorney, Agent, or Firm*—Frishauf, Holtz, Goodman & Woodward

[57] ABSTRACT

Pressurized water is used to operate a percussive down-the-hole drill and the spent motive fluid is used as a flushing fluid. A rear cylinder chamber (24) is constantly pressurized and a valve (28) controls the inlet from the chamber (24) to a bore (23) through the piston hammer (21). A valve (42) controls the outlet from the front cylinder chamber (26) to a flushing channel (38) in the drill bit (21). A check valve (45) controls the outlet from the bore (23) to the front cylinder chamber (26).

4 Claims, 9 Drawing Figures

HYDRAULIC DOWN-THE-HOLE ROCK DRILL

This invention relates to a hydraulic down-the-hole rock drill comprising a housing forming a cylinder, a drill bit slidably received and retained by the front end of said housing and having a flushing passage leading to its front end, a piston hammer reciprocable in said cylinder for repeatedly delivering impacts to said drill bit, said piston hammer having a through central channel and having a front drive surface in a front cylinder chamber (26) for forcing the piston hammer rearwardly in its return stroke and a rear drive surface in a rear cylinder chamber for forcing the piston hammer forwardly in its work stroke, said rear drive surface being smaller than said front drive surface, a valve responsive to the position of the piston hammer for controlling the supply of pressure liquid to the channel of the piston hammer, and an outlet valve for controlling the outlet from said front cylinder chamber to said flushing passage.

Percussive down-the-hole rock drills or in-hole drills or downhole drills as they are also named are mounted on the front end of a drill pipe. The drill pipe transmits rotation and feeding force from a device outside the borehole. Thus, the entire drill rotates in the hole while its hammer piston hammers on the drill bit. The drill pipe transmits the pressurized motive fluid to the drill.

The impact power of down-the-hole drills is usually small as compared with the impact power of top hammers because the maximum radius of the drill is limited and thereby the drive area of the piston hammer. Usually down-the-hole hammers are pneumatically operated and the drive pressure is therefore comparatively low. The quotients between the drive areas and the borehole area will be smaller the smaller the hole area is and, thus, small diameter down-the-hole drills are not very powerful. Usually, down-the-hole drills are used for drilling holes wider than 75–100 mm.

In U.S. Pat. No. 4,450,920 a hydraulic rock drill is described which could be used as a down-the-hole drill. It has no outlet valve and the water consumption will therefore be undesirably high. An alternative design is shown which has an outlet valve. The outlet valve is controlled by the pressure in a control chamber. Since the pressure in the control chamber must be supplied through a control passage indicated in the drawing, this design is not suitable for a down-the-hole drill. The control passage would have to extend through the housing which would make the housing complicated and reduce the diameter of the piston hammer and the impact power.

It is an object of the invention to provide a powerful inexpensive, simple, rugged, efficient down-the-hole hammer that is hydraulically operated and in which the spent motive fluid is used as a flushing fluid and it is a particular object to provide a small diameter down-the-hole drill of this kind.

The invention will be described with reference to the accompanhing drawings.

Figure 1:
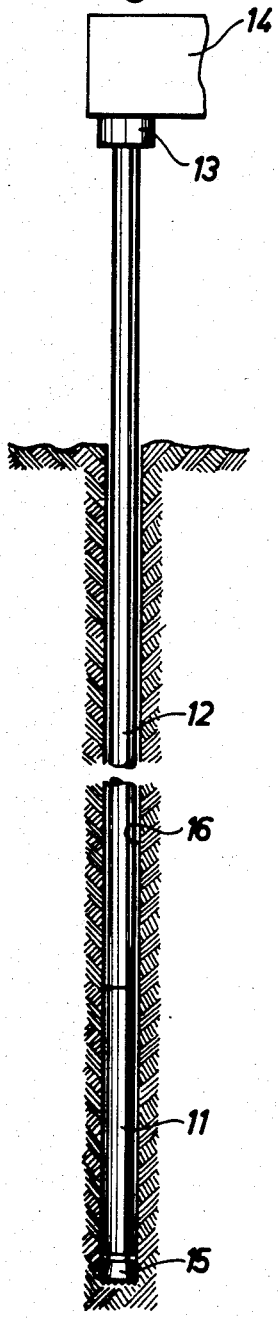
FIG. 1 is a side view of a down-the-hole drill in operation.

In FIG. 1, a down-the-hole drill 11 is coupled to a drill pipe 12 by being screwed to it, and a chuck 13 is arranged to rotate the drill pipe 12 and to apply a feed force to it. The chuck 13 is part of a drilling rig 14. The drill 11 includes a percussive drill bit 15 with inserts in the form of carbide buttons, which break the bottom of the borehole 16. The drill pipe 12 conveys pressurized hydraulic fluid, usually water to the drill 11.

Figure 2:
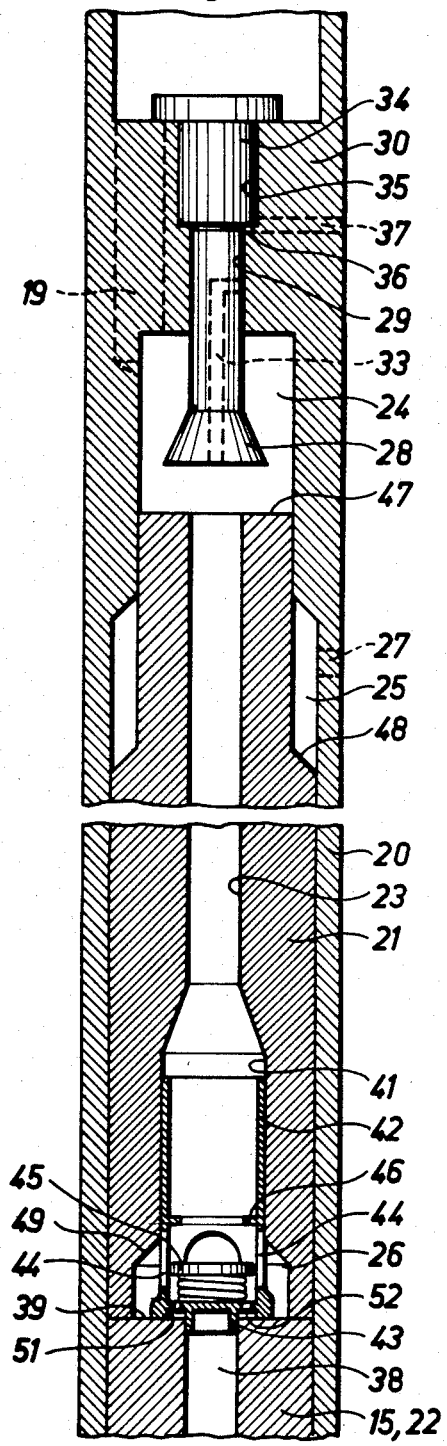
FIG. 2 is a schematic longitudinal section through the down-the-hole drill shown in FIG. 1.

FIG. 2, the drill 11 is shown in a longitudinal section. It comprises a housing 20 which forms a cylinder for a piston hammer 21 that has a cavity in the form of a central longitudinal bore 23. A shank 22 of the drill bit 15 extends into the housing 20 and is retained by the housing in such a way that it is limitedly slidable. The end face 39 of the shank 22 forms an anvil surface on which the piston hammer 21 impacts. The housing 20 has a backhead 30 that is screwed to the drill pipe 12. About half the length of the piston has been cut away in the FIGS. 2–7 as indicated in the Figures.

The piston hammer 21 forms three cylinder chambers with the housing, namely a rear cylinder chamber 24 that is continuously pressurized from the drill pipe 12 by means of a passage 19, an intermediate cylinder chamber 25 that is continuously drained through a bore 27 that leads through the housing 20 to the space between the housing 20 and the wall of the borehole 16, and a front cylinder chamber 26 adjacent the shank 22 of the drill bit 15. The piston hammer 21 has a drive surface 47 in the rear cylinder chamber 24, a surface 48 in the intermediate cylinder chamber 25 and a stepped drive surface 49 in the front cylinder chamber 26. Because of the surface 48, the effective area of the surface 49 is greater than the effective area of the surface 47. Since there are no axial passages outside of the piston hammer 21 and there is only a single channel 23 in the piston hammer 21, the effective areas are greater as compared with the borehole than in conventional down-the-hole drills. Thus, this design makes it possible to make a powerful drill for small diameter holes.

Figure 3:
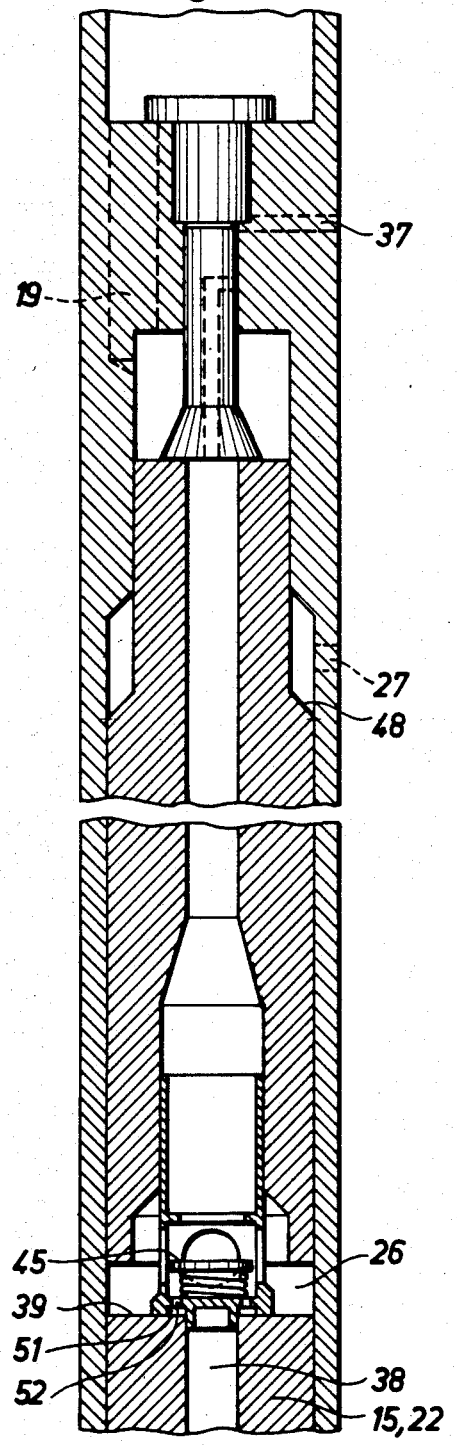
FIGS. 3–6 are sections corresponding to FIG. 2 but showing various parts in other relative positions.

An inlet valve 28 is slidably guided in a central bore 29 in the backhead 30, and it is arranged to seat against the piston hammer 21 as can be seen in FIG. 3. The inlet valve 28 has a passage 33. The bore 29 is stepped and a support piston 34 is arranged in the upper wider part 35 of the bore 29. An intermediate chamber 36 is formed between the inlet valve 28 and its support piston 34 and this chamber 36 is continuously open to the borehole 16 through a passage 37 and thereby continuously drained so that the support piston 34 is biassed against its forward end position and the inlet valve 28 is biassed to rest against the support piston 34 as shown in FIG. 2.

The drill bit 15 has a passage 38 leading from the rear end face 39 of its shank to the front end of the bit. The passage 38 is coaxial with the shank, and it can suitably be bifurcated in the conventional way so that it has two openings to the front end of the bit.

The central bore 23 of the piston hammer 21 has a widened front portion 41 that forms a cylinder for an outlet valve 42 that is arranged to control the outlet from the front cylinder chamber 26 to the passage 38 in the drill bit 15. The outlet valve 42 is in the form of a stepped tube that has four side holes 44 and a tubular extension 43 that is arranged to extend with a sliding fit into the passage 38 in the drill bit shank while the rim of an annular surface 51 is arranged to take support against the end face 39 of the drill bit shank. Small holes 52 ensures that the pressure in the front cylinder chamber 26 is transmitted to the annular surface 51 while the outer rim of the surface 51 takes support against the surface 39. The effective area exposed to the passage 38 is thus smaller than the effective area exposed to the pressure in the bore 23. A check valve 45 is arranged to seat against a shoulder 46 in the outlet valve 42 so as to permit a flow out of the central bore 23 to the cylinder chamber 26 but to prevent a flow in the opposite direction.

The check valve 45 is schematically shown as a spring biassed plate. Instead of being a plate, it could have a axial length exceeding its diameter and it could be tightly guided. No spring would be needed.

The operation of the down-the-hole drill will now be described. In FIG. 2, the piston hammer 21 has just impacted on the shank 22. The valve 42 is closed and the valve 28 is open. Hydraulic pressure fluid, e.g. water at a pressure of 200 bar, is supplied from the interior of the drill pipe 12 through the passage 19 to the rear cylinder chamber 24. From there, the pressure fluid is conveyed through the central bore 23 of the piston hammer 21 to the front cylinder chamber 26. Since the drive area of the piston hammer 21 for returning the piston hammer 21 is larger than the drive area for moving the piston hammer 21 forwardly, the piston hammer 21 will accelerate backwardly. When the piston hammer 21 reaches the valve 28, as shown in FIG. 3, the inlet valve 28 interrupts the supply of fluid to the central bore 23 of the piston hammer.

Figure 4:
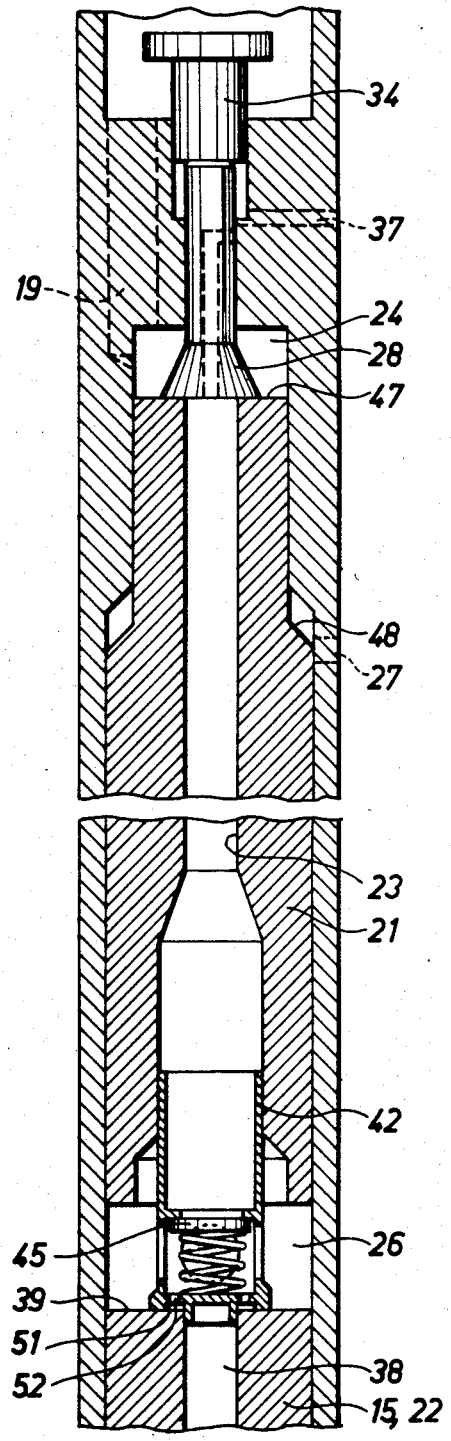
Figure 5:
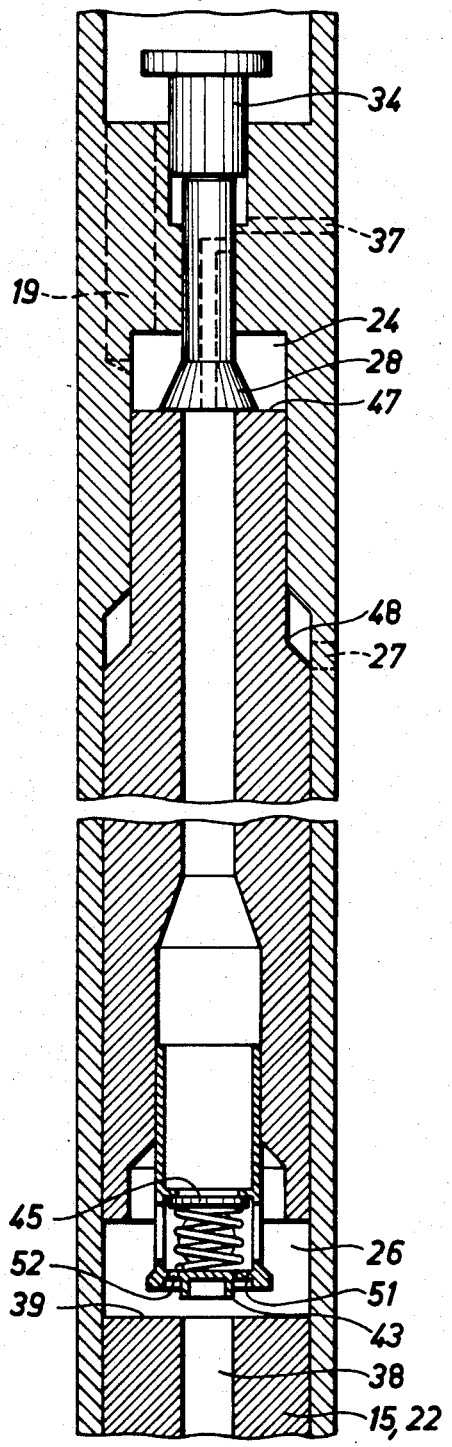
Figure 6:
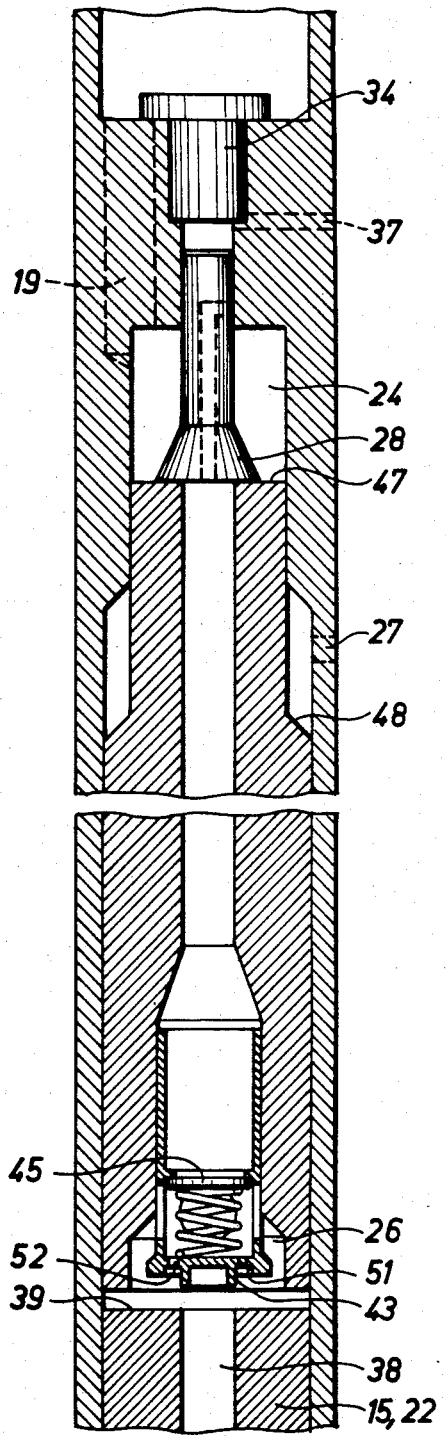

Because of its kinetic energy, the piston hammer 21 continues its rearward movement and lifts the inlet valve 28 and the valve support piston 34 against the force of the pressure fluid acting on the support while the water in the central bore 23 in the piston hammer 21 continues to move forwardly into the front cylinder chamber 26 due to its kinetic energy. The kinetic energy of the water in the hammer piston and the kinetic energy of the hammer piston are of the same order of magnitude because of the higher velocity of the water; the kinetic energy can for example be about the same. Thus, a vacuum is created at the rear end of the central bore 23. The bore 23 must have such a large volume that the vacuum cannot empty it completely. Then, when the piston hammer 21 turns and starts its forward stroke, the check valve 45 closes as can be seen in FIG. 4. When the check valve 45 has closed the pressure in the front cylinder chamber 26 increases over the pressure in the lower part of the bore 23 and, since the annular surface 51 is in pressure chamber 26 because of the holes 52, the outlet valve 42 moves backwardly opening an outlet passage from the front cylinder chamber 26 to the flushing passage 38 as can be seen in FIG. 5 so that the water in the front cylinder chamber 26 rushes out into the passage 38 and flushes away the debris at the front of the drill bit 15. Thus, the check valve 45 is a pilot valve for causing the outlet valve 42 to open. As can be seen in FIG. 6 the valve 28 leaves its support piston and continues to block the bore 23 of the piston hammer 21 during the entire or almost the entire forward stroke of the piston hammer 21 because of the vacuum in the bore 23.

Since the flushing passage 38 is restricted as compared with the area of the piston hammer, and the area of the bore 23 is about the same as the area of the flushing passage 38, a part of the water displaced by the piston hammer 21 during its forward stroke flows into the flushing passage whereas the other part of the displaced water forces the outlet valve 42 rearwardly. Thus, the outlet valve 42 forces the water that remains in the bore 23 rearwardly and when the piston hammer is close to its impact position, the vacuum at the rear part of the bore 23 should be filled so that the water in the bore lifts the valve 28. When the inlet valve 28 opens, high pressure water starts flowing into the bore 23 from the rear cylinder chamber 24 and forces the outlet valve 42 forwardly so that it reaches its closing position at about the same time as, or preferably immediately after, the hammer piston 21 impacts on the anvil surface 39. Because of the momentum of the water in the flushing passage 38, there will be a vacuum in the upper part of the flushing passage 38 when the outlet valve 42 has taken up its closing position, and the outlet valve 42 will be positively held in its closing position. All the parts of the drill are now back in their positions of FIG. 2 and another cycle as described will start.

The passage 33 in the inlet valve 28 opens to the rear cylinder chamber 24 just before the piston hammer 21 impacts on the drill bit 15 and the pressure fluid supplied through the passage 33 to the central bore 23 of the piston hammer 21 will make the valve 28 leave its seat if the valve 28 should not already have been opened by the rearward movement of the outlet valve 42 as described above. Thus, the passage 33 ensures the starting of the operation but it is probably not necessary once the operation has started.

Figure 9:
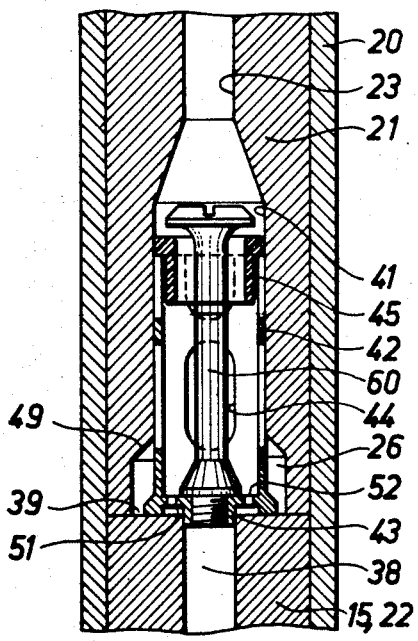
FIG. 9 is a longitudinal section of an alternative design of some of the elements in FIG. 1.

FIG. 9 shows a modified design of the outlet valve 42 and the check valve 45. The check valve 45 which is made of plastics is guided in the outlet valve 42 and it has a flange that is guided in the bore 41. The head of a screw 60 forms the seat for the check valve. The check valve 45 is shown in its open position in which it rests on the valve 45.

Figure 7:
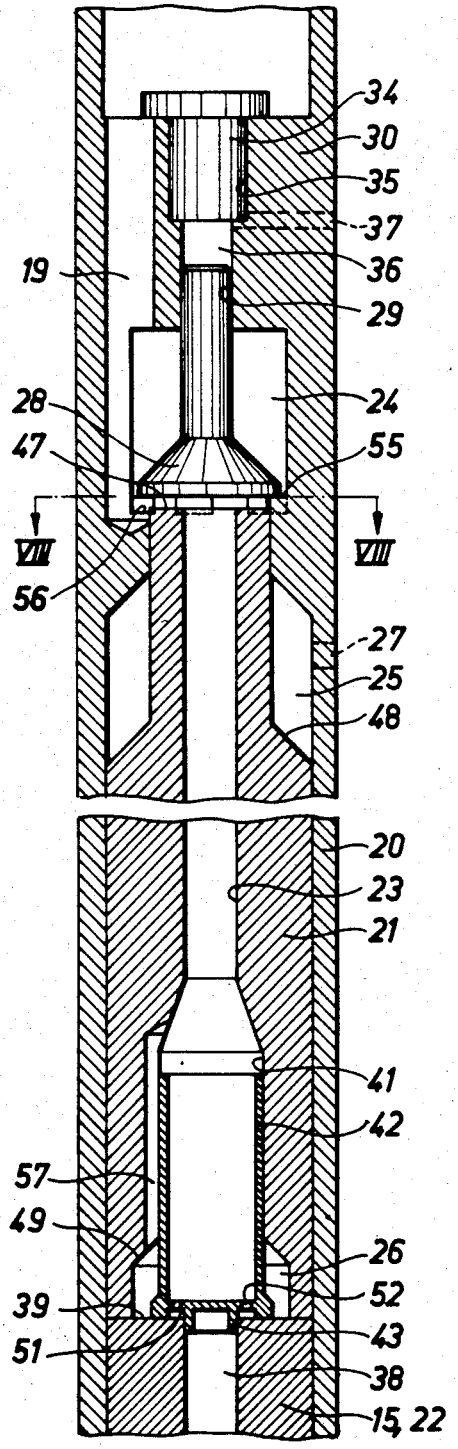
FIG. 7 is a schematic longitudinal section like FIG. 2 but showing alternative designs of some of the elements of the drill.
Figure 8:
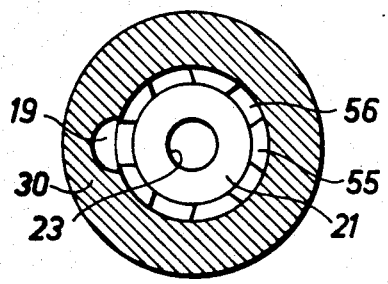
FIG. 8 is a section taken along lines 8—8 in FIG. 7.

In FIG. 7 an alternative design of the drill is shown. Parts that correspond to parts described with reference to the design shown in FIGS. 2–6 have been given the same reference numerals as in those figures. The inlet valve 28 in FIG. 7 is arranged to be arrested mechanically by a shoulder 55 in the housing immediately before the piston hammer 21 reaches its impact position. Thus, the shoulder 55 replaces the passage 33 in FIGS. 2–6. The outlet valve 42 in FIG. 7 differs from the outlet valve 42 in FIGS. 2–6 in that it has no holes 44 and no check valve 45. The flow from the bore 23 to the chamber 26 passes through three grooves 57 in the piston hammer 21 outside of the outlet valve 42. The total area of the grooves 57 should be comparatively small so that the grooves cause a pressure differential between the front end of the bore 23 and the chamber 26 when the piston hammer 21 turns and starts forcing a flow from the chamber 26 through the grooves 57 to the bore 23. This pressure differential will make the outlet valve 42 open.

Above, two alternative designs of the inlet valve 28 have been described. Instead of being a seat valve as described it could also be a spool valve. It could be arranged transversely in the backhead 30 and it could be controlled by one or two control passages with piston hammer controlled ports in the cylinder.

Three alternative designs of the outlet valve 42 have been described above. In two of the designs, a one-way valve 45 causes a pressure differential that opens the outlet valve and in the other design, a restricted passage 57 causes the pressure differential. The use of a check valve is advantageous in that it makes the total water consumption lower for a given impact power, that is, the energy consumption per drilled meter will be lower. The check valve 45 need not be mounted in the outlet valve 42 as shown but it could be mounted in the housing outside of the piston hammer. Then, there must be passages from the bore 25 radially through the piston hammer. The alternative designs of the valves 28 and 42 can be used in a drill in other combinations than illustrated. Also other alternative designs are possible within the scope of the claims.

I claim:

1. Hydraulic down-the-hole rock drill comprising a housing forming a cylinder, a drill bit slidably received and retained by the front end of said housing and having a flushing passage leading to its front end, a piston hammer reciprocable in said cylinder for repeatedly delivering impacts to said drill bit, said piston hammer having a through central channel and having a front drive surface in a front cylinder chamber for forcing the piston hammer rearwardly in its return stroke and a rear drive surface in a rear cylinder chamber for forcing the piston hammer forwardly in its work stroke, said rear drive surface being smaller than said front drive surface, a valve means responsive to the position of the piston hammer for controlling the supply of pressure liquid to the channel of the piston hammer, an outlet valve means for controlling the outlet from said front cylinder chamber to said flushing passage, and means to cause a pressure differential between the front end of the channel in the piston hammer and the front cylinder chamber and to apply said pressure differential to said outlet valve means which is arranged to be controlled by said pressure differential.

2. Down-the-hole drill according to claim 1, wherein said means for causing a pressure differential between the channel in the piston hammer and the front cylinder chamber and applying it to the outlet valve means comprises a check valve means that permits flow only in the direction from the channel in the piston hammer to the front cylinder chamber.

3. Down-the-hole rock drill according to claim 1, wherein said outlet valve means extends into said channel in the piston hammer and has an effective cross section area exposed to the pressure in said channel which is greater than the effective cross section area exposed to the pressure in the flushing passage in the drill bit when the outlet valve means is closed forming an effective differential area which is exposed to the pressure in the front cylinder chamber and strives to open the outlet valve.

4. Hydraulic down-the-hole rock drill comprising a housing forming a cylinder, a drill bit slidably received and retained by the front end of said housing and having a flushing passage leading to its front end, a piston hammer reciprocable in said cylinder for repeatedly delivering impacts to said drill bit, said piston hammer having a through central channel and having a front drive surface in a front cylinder chamber for forcing the piston hammer rearwardly in its return stroke and a rear drive surface in a rear chamber for forcing the piston hammer forwardly in its work stroke, said rear drive surface being smaler than said front drive surface, a valve means responsive to the position of the piston hammer for controlling the supply of pressure liquid to the channel of the piston hammer, an outlet valve means for controlling the outlet from said front cylinder chamber to said flushing passage, and said outlet valve means being responsive to the flow between the channel in the piston hammer and the front cylinder chamber to be closed when there is a flow from the channel to the front pressure chamber and to be opened when there is no flow out of the channel to the front pressure chamber.

* * * * *